United States Patent [19]

Ballew

[11] 4,367,955

[45] Jan. 11, 1983

[54] MEDICAMENT CONTAINER WITH TIMER TOP

[76] Inventor: Donald H. Ballew, 1908 W. Yakima, Yakima, Wash. 98902

[21] Appl. No.: 149,492

[22] Filed: May 13, 1980

[51] Int. Cl.[3] ..... G04B 47/00

[52] U.S. Cl. ..... 368/10; 368/215; 368/98; 215/2

[58] Field of Search ..... 368/10, 12, 97, 98, 368/101, 215, 89; 340/390.1, 390.4; 215/DIG. 3; 221/2

[56] References Cited

U.S. PATENT DOCUMENTS

| | | | |
|---|---|---|---|
| 578,059 | 3/1897 | Hallas . | |
| 650,616 | 5/1900 | Salomon . | |
| 650,617 | 5/1900 | Salomon . | |
| 1,102,798 | 7/1914 | Porter | 368/215 |
| 1,425,456 | 8/1922 | Dial . | |
| 2,604,753 | 7/1952 | Doertenbach et al. . | |
| 2,853,182 | 9/1958 | Barnett | 368/10 |
| 3,762,601 | 10/1973 | McLaughlin | 221/2 |
| 3,818,473 | 6/1974 | Murray et al. | 340/309.1 |

*Primary Examiner*—Bernard Roskoski
*Attorney, Agent, or Firm*—David L. Garrison

[57] ABSTRACT

A combined timer and container for dispensing medicaments is provided wherein a predetermined timer cycle set to coincide with dosage intervals is utilized to activate an audible signal and a visible signal in the cap of the container. The container and cap coact to initiate the timer cycle upon interengagement of the cap and container.

3 Claims, 4 Drawing Figures

Fig. 1.
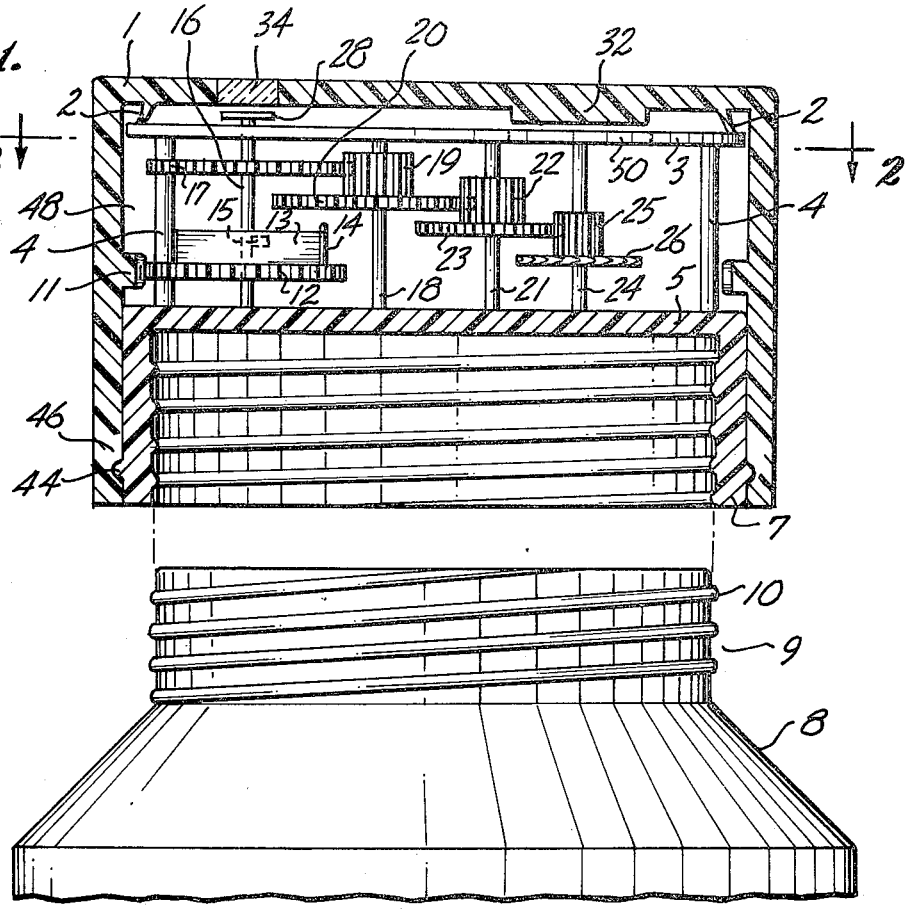
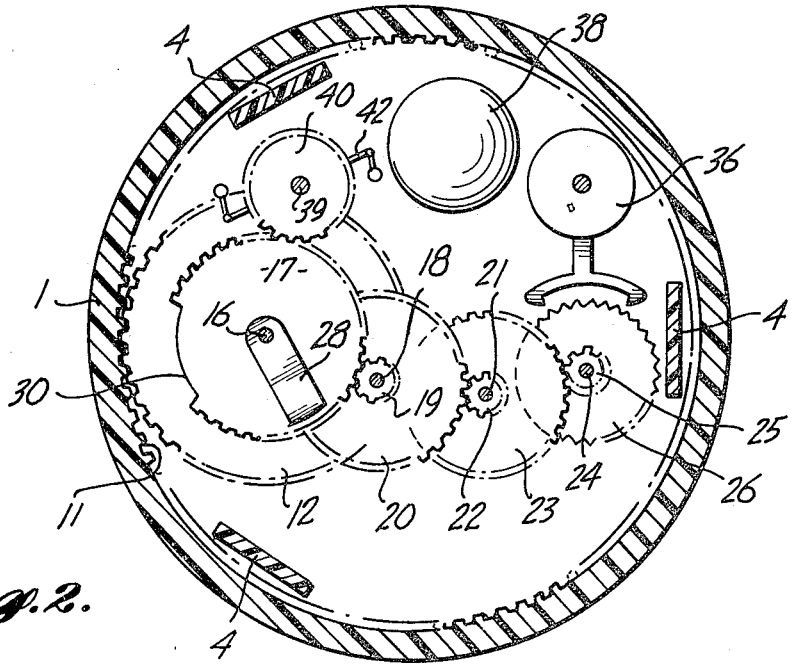
Fig. 2.

MEDICAMENT CONTAINER WITH TIMER TOP

BACKGROUND

A. Field of the Invention

This invention relates to timing and alarm devices, and further relates to timing and alarm devices as applied to the field of medicine.

Many prescribed medicines need to be taken at regular times or time intervals so that a known percentage presence of the medicine can be maintained within the bloodstream. For instance, those medicines used to combat urinary tract infections, heart disease and in control of diabetes must all be taken at prescribed intervals. If such medicines are not taken at time intervals predetermined by the health practitioner, then the health of the patient could be seriously affected. To keep a medicine user as healthy as possible during times when he or she is not directly supervised by doctors or nurses, a convenient reminder is useful to indicate to the use when to self-administer medicaments prescribed by the health practitioner.

B. Prior Art

In the past there have been devices for recording how much medicine was taken in any given dosage or for indicating by a pre-set indicator dial time a dosage should be taken. Multipurpose timers are known which exist apart from the prescription bottle. However, the multipurpose timer's need for winding or time setting attentions is frequently forgotten by the medicine users and, not being incorporated into the container, are frequently not available for use at the time the timer is needed. As a result, most self-administered medicaments are ingested at an irregular schedule, often adversely affecting the efficacy of the medicament. In some instances the health and well-being of the patient are thereby adversely affected.

C. Objects of the Invention

It is an object of this invention to provide a combined medicament-timer mechanism for storing a medicament and indicating an elapsed time interval for administration of the medicament.

It is another object of this invention to provide a timer mechanism in conjunction with a medicament bottle or container which timer incorporates, in one embodiment, a mechanical clock escapement mechanism for timing a set time interval together with audible alarm means.

It is a further object of this invention to provide a timer and medicament bottle of the nature described in which the timer mechanism is an electronic device having a minimum of moving parts.

It is a still further object of this invention to provide a timer mechanism for use with a medicament container in which the timer mechanism may be set for intervals usually encountered in the self-administration of medicaments to the patients of health practitioners.

SUMMARY

A timing and alarm device contained within a medicine bottle cap is provided wherein the timer is adapted to measure an interval suitable for the repeated administration of drugs. The purpose of the alarm device is to signal the medicine user, both visually and audibly, when a prescribed medicine dosage should be taken. The timer may be either the well-known escapement-type mechanical clock means having a unique alarm mechanism as described more in detail below or may be a solid state electronic device containing any one of a number of well-known timing circuits and devices adapted to time an elapsed period of rather short duration. As is well known in the administration of medicaments, the usual time periods prescribed are four, six, eight, twelve, or 24 hours, depending on the nature and dosage rates of the material being administered. In the self-administration of such medicines, a timer adapted to sound an audible signal and otherwise warn the user of the need to administer the next dosage is incorporated directly into the top or cap of the bottle. The timer is activated by manipulative movement of the act of closing the container to initiate the timing cycle.

In the embodiment utilizing a clock escapement or mechanical timing device, the invention utilizes the interengagement of the top and container to perform the function of winding the mainspring of the clock device. The winding functions for both winding the mainspring on its arbor post and presetting the time interval are performed by placing a torque on the medicine bottle cap contained on the medicine bottle, which is equal to the direction and placement of torque needed to rotatively secure the medicine bottle cap on complementary threads on the medicine bottle. In other words, the medicine bottle cap is first screwed onto the medicine bottle and any further turning of the medicine bottle cap iin the same direction performs a winding of the timing and alarm device contained therein.

When it is desired by the medicine user to wind and set the timing and alarm device for a prescribed time interval, the medicine bottle cap is wound or screwed onto the medicine bottle until the point at which the threads contained within the medicine bottle cap have received their full complement of threads contained on the medicine bottle, at which point cogs on the inner circumference of the medicine bottle cap engage a winding wheel which winds the mainspring of a timer on its arbor post. In one embodiment the time interval of the fully wound timer bottle cap is preset at the point of manufacture by a specific construction of the clock escapement. In the alternative, means are provided by which the duration of the timed sequence may be preset by the pharmacist and the medicine user need only wind the timer fully by turning the timer bottle cap until a stop is reached for the preset time interval.

A more universally useful timer may also be provided in which the time interval is indicated on the timer and set by the user to establish each timer interval. This more universal arrangement permits reusage by the patient for various prescriptions to be administered on different time cycles.

The alarm portion of this invention signals the medicine user at the prescribed time for medicine dosage with both audible and visual signals. The audible signal is preferably a mechanically operated bell sounded by a spring-driven rotating mechanism. Preferably, the device provides for disengagement of the mainspring from the clock escapement at the end of the timer cycle with the remaining force of the mainspring being then applied to the alarm sounding mechanism. Prior to the alarm bell sounding the center wheel teeth are engaged with the movement wheels and escapement through respective pinions and movement wheels. At the end of the prescribed time interval, whether this interval has been predesignated as the only interval for a timer or whether the medicine user can set different time intervals at their own discretion, a gap in the toothed portion of the center wheel reaches the escapement drive pinion. As a result, the center wheel disengages from the escapement drive pinion and, urged by the now unrestrained mainspring, the center wheel spins rapidly on its arbor post causing an alarm drive pinion, also engaged with the teeth of the center wheel, to spin rapidly. Alarm arms attached to the alarm wheel extend centrifugally and repeatedly strike the alarm bell.

A visual indicator appears through an aperture in the top at the end of the prescribed time interval. The indicator is a color dot which appears in a view window aperture in the timer bottle cap at the prescribed time for medicine dosage. After the center wheel has spun rapidly to ring the alarm bell and the center wheel teeth once again become engaged with the first movement wheel pinion, the center wheel is stopped in its rotative movement and the visual indicator appears in the view window in the timer bottle cap.

BRIEF DESCRIPTION OF THE DRAWINGS

FIG. 1 is a view of one embodiment of the invention.

FIG. 2 is a cross sectional view of the cap.

DESCRIPTION OF THE PREFERRED EMBODIMENT

Figure 3:
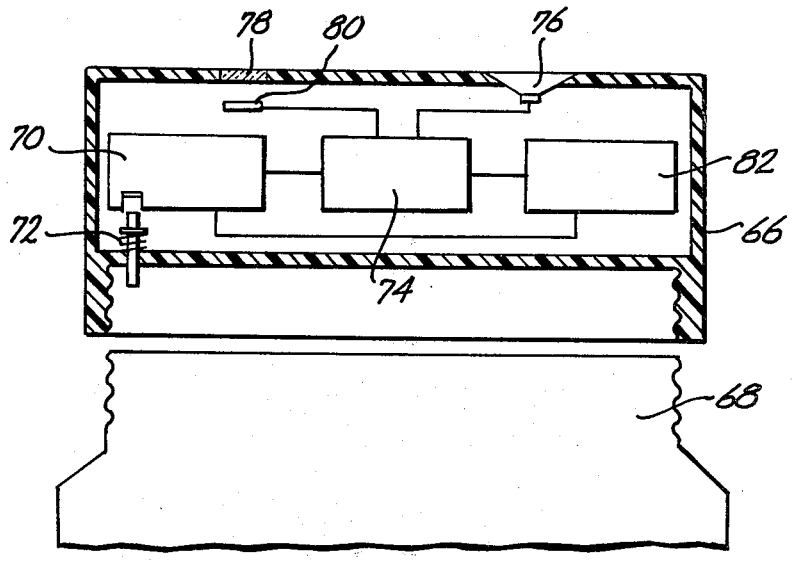
FIG. 3 is a view showing a second embodiment of the invention showing a functional block diagram.
Figure 4:
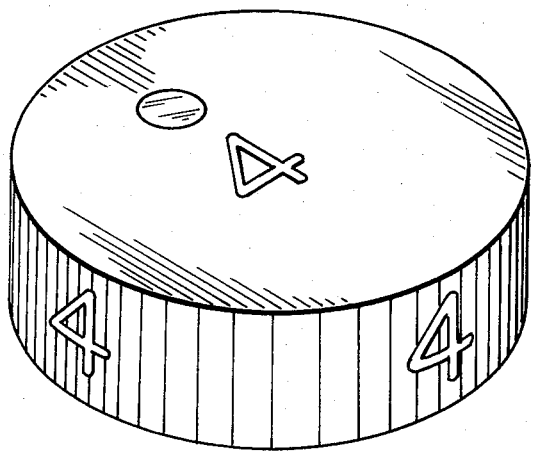
FIG. 4 is a view of the cap of FIG. 3 for a four hour interval.

As shown in FIG. 1, one preferred embodiment of this invention consists of a bottle 8 having a container neck 9 with container neck threads 10 contained thereon and an outer cap 1 having a timer escapement 48 and an inner cap 7 contained therein.

A bottom bearing plate 5 retains the timer works 48 within the outer cap 1 and atop the inner cap 7. Support legs 4 are fixed to the bottom bearing plate 5 and support a top bearing plate 3. Flexible standoffs 2 attached to the outer cap 1 separate the outer cap 1 from the top bearing plate 3. An uninterrupted circumferential flange 44 is attached to the outer surface of the inner cap 7 and the outer cap 1 has a circumferential guideway 46 which receives the flange 44 of the inner cap 7. The inner gap 7, bottom bearing plate 5, support legs 4, top bearing plate 3 and the timer works 48 therebetween are retained in the outer cap 1 by means of the interengagement of the guideway 46 and the flange 44.

Cog teeth 11 fixed to the inner wall of the outer cap 1 are unidirectional ratchet teeth which engage the winding wheel 12 of the timer works 48. When the outer cap 1 is rotated in a clockwise direction relative to the inner cap 7 and timer works 48, the mainspring 13 is wound up to operate the timer works 48. The arbor 16 of the winding wheel 12 is journaled for rotation in the top bearing plate 3 and in the bottom bearing plate 5. Mainspring 13 is fixed to the arbor 16 with a spring hook 15 and the mainspring 13 is attached to the winding wheel 12 at spring post 14.

Elevated from the mainspring 13 and attached to the arbor 16 is center wheel 17. Center wheel 17 is in toothed engagement with a second movement wheel pinion 19. The second movement wheel pinion 19 has an arbor 18 which is journaled for rotation in both the top and bottom bearing plates 3 and 5, respectively. Common to the arbor 18 is a second movement wheel 20 which is in toothed engagement with a third movement wheel pinion 22. The third movement wheel pinion 22 has an arbor 21 which is journaled for rotation in the top and bottom bearing plates 3 and 5, respectively. Common to the arbor 21 is a third movement wheel 23 which is in toothed engagement with an escape wheel pinion 25. The escape wheel pinion 25 has an arbor 24 which is journaled for rotation in the top and bottom bearing plates 3 and 5, respectively. Common to the arbor 24 is an escape wheel 26 which is in toothed engagement with an escapement 36 as shown in FIG. 2. As shown in FIG. 2, the center wheel 17 has a center wheel gap 30 extending from the minor diameter of the center wheel 17 to the major diameter of the center wheel 17. In toothed engagement with the center wheel 17 is an alarm wheel 40 and attached in opposing radial directions from the arbor 39 of the alarm wheel 40 are hinged arms 42. An alarm bell 38 is fixed to the bottom bearing plate 7 within striking distance of the hinged arms 42 when fully extended.

The timer works 48 is wound when the winding wheel 12 is caused to turn mainspring 13 about its arbor post 16. The winding wheel 12 is turned in the following manner: the medicine user rotates the outer cap 1 with the fixed cog teeth 11 in a clockwise direction relative to the inner cap 7 and the timer works 48. The cog teeth 11 engage the teeth of the winding wheel 12 in this relative clockwise direction and the torque of the rotating outer cap 1 is transmitted through to the center wheel 12 as it acts on the mainspring 13. Until the inner cap and container are secured the mainspring 13 will not be wound on its arbor post 16, because the torque required for rotatively securing the inner cap 7 to the medicine container 9 is less than that torque needed to wind the mainspring 13 of the timer works 48. Once the inner cap 7 is rotatively secured to the container neck 9 so that the top of the container neck 9 abuts the bottom bearing plate 5, the torque required for any further rotative securing of the container neck 9 into the inner cap 7 becomes greater than that torque needed for winding the mainspring 13 on the arbor 16 by means of the toothed engagement of the outer cap cogs 11 and the winding wheel 12, and, as a result, the mainspring 13 is wound.

The torque applied to winding wheel 12 by unwinding the mainspring 13 will cause the winding wheel 12 to rotate in a counterclockwise direction relative to the cog teeth 11 of the outer cap 1. In this counterclockwise direction, the winding wheel 12 disengages from the one-way ratchet teeth of the cog teeth 11. The torque applied by unwinding the mainspring 13 is also transmitted through the arbor 16 to the center wheel 17 and thence through the timer works 48 in a manner commonly known in the prior art. From the center wheel 17, the torque goes through the pinion 19, through the second movement wheel 20, through the pinion 22, through the third movement wheel 23, through the pinion 25, and through the escape wheel 26 to the escapement 36, which escapement serves as a speed governor for the timer works 48. The diameters and toothed arrangement of the center wheel 17 and the second and third movement wheels 20 and 23, respectively, and the second and third movement wheel pinions 18 and 22 respectively will have been predetermined such that when the container neck 9 is rotatively secured to the bottom bearing plate 5 and when the mainspring 13 is completely wound on the arbor 16, the timer works 48 will time an interval coincident with a prescribed interval separating medicine dosages and such an interval being predetermined by varying the characteristics of the timer works 48.

The user is made aware of the proper time for medicine dosage by both audible and visual signals. The audible signal is produced in the following manner: Once the prescribed and predetermined time interval has passed, the center wheel gap 30 of the center wheel 17 having no gear teeth, as shown in FIG. 2, reaches the second movement wheel pinion 19. The center wheel 17 disengages from pinion 19 and the center wheel 17 rotates rapidly from the torque of mainspring 13. Being in toothed engagement with the center wheel 17, the alarm wheel 40 with hinged arms 42 will spin rapidly about its arbor 52 and the hinged arms 42 will extend and strike the alarm bell 38, thus signalling the user to self-administer a medicine dosage.

The visual indicator of the preferred embodiment consists of a visual indicator arm 28, as shown in FIGS. 1 and 2, which is fixed for rotation on the arbor 16 above the top bearing plate 3. The indicator arm 28 and indicator viewing aperture 34 are arranged such that the indicator arm 28 is visible to the medicine user through the aperture 34 when the gap 30 of the center wheel 17 has completely tangentially traversed the pinion 19 and the torque of the wound spring 13 is exhausted.

To unscrew the outer cap 1 and inner cap 7 from the container neck 9 the user presses downwardly on the outer cap 1 thus bending the flexible standoffs 2 and engaging pegs 32 with peg slots 50 in the bearing plate 3 so that the outer cap 1 is firmly engaged with the inner cap 7 and so that the inner cap 7 may be rotatably separated from the inner neck 9 and the medicine obtained. The circumferential flange 44 and circumferential guideway 46 assure that the inner cap 7 and the timer works 48 will not fall from the outer cap 1 when the outer cap is removed from the container 8. The width of the outer cap cogs 11 and the guideway 46 assure that the outer cap with pegs 32 may be pressed downwardly for the engagement of pegs 32 with peg slots 50 without loosing the engagement of the flange 44 with the guideway 46 and the center wheel 12 with the outer cap cog 11.

FIG. 3 shows a second embodiment of this invention in which an electronic timing means shown generally at 70 is used to control the duration of the timing cycles for this invention. An alarm mechanism 74 having an audible sounding means 76 and a mechanically operated visual indicator 80 visible through aperture 78 is shown. The timing device 70 and the alarm device 74 are both driven by a suitable power supply 82 such as a miniaturized nickel-cadmium battery or the like. The elements are all enclosed within cap 66 adapted to rotatively engage container 68. The upper lip of container 68, when fully engaged with cap 66, presses timer-actuator 72 into timer means 70 to initiate the timing of an interval preset by timer 70.

Timer 70 may be any of a number of well-known timing devices, suitable for timing intervals from two to 24 hours. For example, a charged capacitor with a controlled decay rate could be utilized. Similarly, digital timing techniques, quartz crystals, resonant circuitry or the like may be utilized, all as is well known in the timer arts.

While the inventor has described his invention in terms of specific preferred embodiments, it is apparent that various minor modification and changes are well within the scope of this invention and may be made without departing from the spirit and scope hereof.

I claim:

1. A timing and alarm device for signalling a medicine user at the prescribed time for self-administration of medicine from a medicine container, comprising:

a medicine container means having attachment means thereon for receiving and holding a cap;

a cap for said container means having a timing and alarm signalling means therein, said timing and alarm signalling means being activated to time then signal a predetermined elapsed time by means initiated by relative rotation between said container and said cap; said cap having winding means pivotally mounted on a first shaft means, said winding means operatively connected to a timer mainspring means and mounted in said cap for engagement with said container means, whereby rotation of said cap with respect to said container means applies torque to wind said mainspring for operating said timer and alarm signalling means.

2. The device of claim 1 wherein the alarm signalling means comprises:

a center wheel having circumferentially positioned gear teeth positioned around a major portion thereof with a gap in said gear teeth extending around a minor portion of said wheel;

a first pinion wheel engaged for rotation with said circumferentially positioned gear teeth said pinion wheel being operatively connected to a clock escapement means to regulate rotation thereof;

an alarm wheel means driven by said center wheel and alarm arms attached to said alarm wheel means, said arms located within striking distance of an alarm bell means such that disengagement of the first pinion wheel with said gear teeth at said gap permits rapid and unrestrained rotation of said center wheel and rapid rotation of the alarm wheel carrying said alarm arm means to centrifugally fling said alarm arm means out to strike said alarm bell.

3. The timing and alarm device of claim 1 further comprising:

visual indicator arm means rotatively attached to the arbor of the center wheel means; and window means to view said visual indicator arm at a predesignated time such that the disengagement of the center wheel means from the first pinion wheel means causes the visual indicator arm to turn rotatively about the axis of the center wheel means and become revealed in said window means.

* * * * *